United States Patent [19]

Kiefer et al.

[11] 4,203,264

[45] May 20, 1980

[54] FIREPROOF BUILDING ELEMENT

[75] Inventors: Werner Kiefer; Dieter Krause, both of Mainz-Mombach; Herwig Scheidler, Finthen; Hans-Wilhelm Schulze, Main; Klaus Kristen, Wiesbaden, all of Fed. Rep. of Germany

[73] Assignee: JENAer Glaswerk, Schott, Fed. Rep. of Germany

[21] Appl. No.: 878,530

[22] Filed: Feb. 16, 1978

Related U.S. Application Data

[63] Continuation of Ser. No. 679,851, Apr. 23, 1976, abandoned.

[30] Foreign Application Priority Data

Apr. 30, 1976 [DE] Fed. Rep. of Germany ..... 2519176

[51] Int. Cl.[2] ..... E04B 1/92; E06B 9/02

[52] U.S. Cl. ..... 52/1; 52/171; 52/232; 52/789

[58] Field of Search ..... 52/168, 171, 172, 232, 52/1, 789

[56] References Cited

U.S. PATENT DOCUMENTS

| | | | |
|---|---|---|---|
| 358,324 | 2/1887 | Baush | 160/1 |
| 980,443 | 1/1911 | Shuman | 160/1 |
| 3,907,020 | 9/1975 | Root | 160/1 |
| 3,952,947 | 4/1976 | Saunders | 52/171 |
| 3,991,531 | 11/1976 | Becker | 52/172 |

*Primary Examiner*—John E. Murtagh

*Attorney, Agent, or Firm*—Quaintance, Murphy & Richardson

[57] ABSTRACT

Fireproof building element with a multi-sheet glazing unit of glass or glass ceramic characterized in that at least one of the glass sheets is a fire resistant glass sheet. The building element contains one or more high heat reflective foils arranged between the sheets at a distance from the fire resistant glazing unit. The foils can be put in a rolled or folded form between the two sheets of the building element such that the visible area is not covered, and they can, in the event of a fire, be spread out completely between the sheets.

21 Claims, 4 Drawing Figures

FIREPROOF BUILDING ELEMENT

CROSS-REFERENCE TO RELATED APPLICATION

Figure 1:
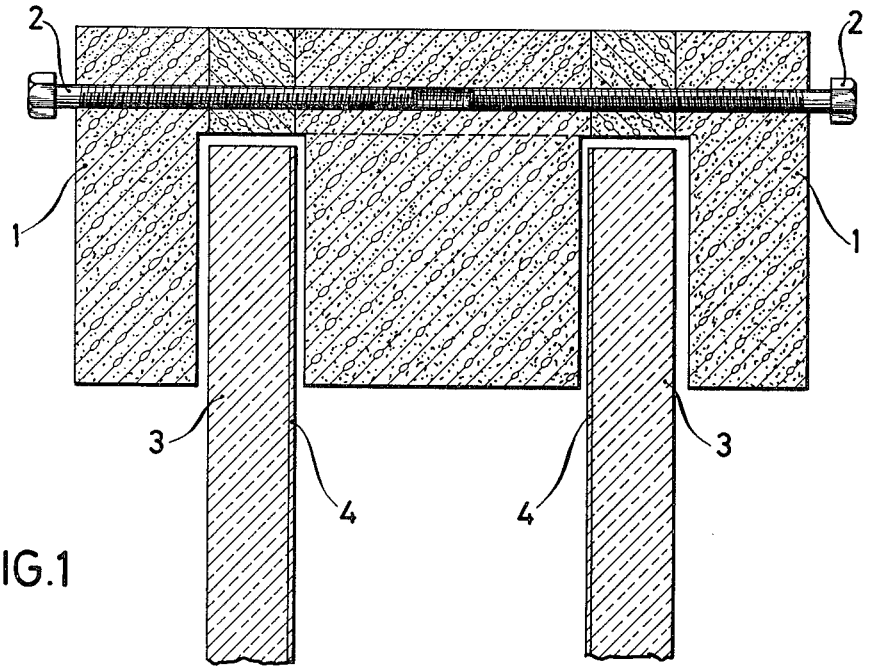

This application is a continuation of Ser. No. 679,851, filed Apr. 23, 1976, now abandoned.

DESCRIPTION OF THE INVENTION

The invention is concerned with a fireproof building element with glazing units of glass or glass ceramic. The building element according to the invention has at least one fire resistant glass sheet which in the event of a fire hinders the passage of the fire and smoke for at least 60 minutes and at least one of the sheets has a high heat insulation so that the heat transport through the building element is greatly reduced from the side where the fire is occurring to the side where the fire is turned back.

To be sure a not easily solved problem in building fireproof materials are glazing glass units. At the start of a fire most unhardened or even hardened glazing units break. As for example, crystal mirror glass, float glass or hardened window glass after just a few minutes break and thereby give the fire a free passage through the opening.

In German Industrial Standard 4102, page 3, section 7 (Edition February 1970) there is given what is required of a fire resistant glass sheet and which requirements such a glazing unit at least in trials must satisfy. According to this then, such a glazing glass, of a size and structure as would be used in a practical structural unit, must withstand a heating rise according to the standard temperature curve (German Industrial Standard 4102, side 2, section 5) for at least 60 minutes and the room closure must remain workable and neither flame nor smoke allowed to penetrate the closure.

In the German Industrial Standard (DIN) 4102, page 3, section 7 there are recited standards of performance of fire-resistant glazings, to which the glazings used in the instant invention conform. Section 7 is translated into English as follows:

7. Fire-Resistant Glazing.

7.1 Definition

Fire resistant glazings are glass elements which are designed to prevent passage of flame and smoke for 60 minutes, but not the passage of radiation, and includes the dimensions and the type of installation, as they have been tested.

7.2 Requirements

Fire resistant glazings, including their mountings, fasteners and joints, must show during an hour long trail-fire according to Paragraph 7.3 such a resistance to the action of the fire that they remain workable as room closures and let neither flame nor smoke pass through.

7.3 Examination 7.3.1 The glazing is installed in the fire-testroom with the dimensions and in the manner for which it is intended in practical application. For the test method DIN 4102, Page 2, Paragraph 5.1 and 5.251 is applied accordingly.

7.3.2 For the proof-certificate DIN 4102 Page 2, Paragraph 5.4 is applied accordingly. The type of installation and the dimensions tested are reported.

Since known window glass sheets, as expected, under these conditions break, the above presented requirements are to be sure practically only fulfilled through glass reinforced with wire. To be sure, in the case of fire, these also break but the wires in the glass hold together, however, for the required 60 minutes and during this time the passage of flames and smoke is hindered.

The use of glass reinforced with wire is, however, in many cases undesirable from an architectural and aesthetic point of view and mars transparency in many cases.

Sheets which do not contain wire reinforcement can only hinder the passage of flames and smoke under the above given conditions if they do not break during the required 60 minutes.

This situation can be fulfilled for example, through fire resistant glazing units which use sheets of glass ceramic of a low thermal expansion value. These, for example, are described in German language publications 1,596,858 and 1,596,863. Sheets of glass ceramic are, however, very expensive.

More recently fire resistant glazing units have been found, which have sheets made of a special glass which, naturally, must be subjected to a particular treatment. Such sheets, respectfully as glazing units, are described in German language publications 2,313,442, 2,413,552 and 24 24 172. While the fire resistant glass sheets hinder the direct passage of fire and smoke they may not be set below 1.8 meters in fire resistant doors or in fire resistant partitions which separate a passage way. This is traced back to the fact that the radiation which penetrates the glazing unit in the case of a fire with a rising temperature make it impossible to provide a stop in the vicinity (2 to 3 meters) of the glazing unit.

Measurements on 7 mm glazing units have shown that after a 30 minute fire following the standard temperature curve according to German Industrial Standard 4102 a temperature of 600° C. is obtained on the side of the glazing unit toward the fire.

Flammable material which touches the glazing unit or is in close vicinity to the glazing unit can easily ignite and thereby make an indirect passageway for the fire.

For these given reasons there is a need for fireproof building elements with glazing units. Such building elements are the goal of the present invention.

These building elements could be used for fire proof doors and partitions, railings, outer claddings and similar types of application.

Besides the fire resistance property it is generally additionally required of a fireproof building element that it have heat insulating properties.

Heat is known to be conveyed through convection; conduction and radiation. By controlling each of these three quantities can the heat insulation be improved.

The heat transfer through conductance can be minimized through a double or multi-glazing unit. Here one must be careful that at least the sheet toward fire is fire resistant. If the interspace between the sheets is not too great, for example, 10 to 50 mm, then the sheet away from the fire must consist also of a fire resistant unit. Such building elements with double or multiple fire resistant glazing units have already been described. Those with a double or a triple glazing unit did not accomplish the desired diminishing of the heat flow in order to attain the expected heat insulation for the German Industrial Standard 4102 for fireproof partitions. Thus, it is established that for a 30 minute fire according to German Industrial Standard 4102 (standard temperature curve) the temperature on the side of the glazing unit toward the fire rises to about 450° C.

While at room temperature a great part of the heat is transferred by means of convection and conduction, it is realized that with higher temperatures, such as occur with the onset of a fire, the heat transfer for the greatest part proceeds by radiation.

Other processes are known to minimize the heat transfer through radiation at room temperature or with the incidence of light from the sun by using insulation glass units with an IR reflective layer of metal or metal oxide. The IR reflective layer is usually placed on the inner side of one or the two insulating glass sheets.

The insulating glass sheets consist in general of unhardened or hardened by rapid quenching float or building glass sheets of calcium-sodium-glass.

At the out break of a fire these sheets break even if they have IR reflective layers so that the building element with such glazing units hinders neither the passage of the flame during a fire nor serves as a heat insulation.

The invention consists therefore in a fireproof building element with glazing units which are characterized in that at least one of the sheets is a fire resistant sheet and that the building element contains a high heat reflective foil arranged in rolls or in a folded condition between two sheets of the building element such that the visible area is not covered and the foil can, in the case of fire, however, be fully lowered and spread out between the sheets.

As heat reflective foils, preferably metal foil as, for example, aluminum or gold foils, can be used. The heat reflective foils can either be self contained or they can be put on another surface as, for example, on mineral fibers.

Through the very good heat insulation of a claimed building element the sheet toward the burning rooms quickly takes the temperature. Then one such sheet with aluminum foil on the inner side rather quickly begins to melt. The foil on the sheet away from the fire still reflects the heat radiation and thereby effects a high heat insulation.

The employment of the foil in the interspace has the advantage that the foil is practically not heated since it has no conductive contact with the glass sheets. Therefore, the foil diminishes the convection in the interspace between the sheets so that even the remaining heat flow is still further reduced. The heat insulation can, as expected, still be improved by using in the interspace instead of one foil, multiple foils which are put between yet smaller interspaces. Since a few foils do not reflect the heat radiation to 100 percent the rest of the heat radiation will be reflected through the remaining foils. Also, through the greater number of foils the convection will be minimized.

To be sure, fire safe heating elements with glazing units have been described by which the heat transfer through radiation and convection have been diminished. However, even the heat transfer through conduction can be decreased if the interspace between a double or a multi-layered glazing unit is filled with a gas (for example, rare gas) and at least one of the sheets is of a fire resistant unit and the outside heat conductor is air.

The described methods of improving the heat insulation of the fire safe building element with glazing units depends on stopping the heat flow through the building element to the greatest extent so that the heat transfer by means of convection, radiation and conduction is minimized.

If the heat insulation of the building element, particularly in the case of a fire, is to be workable then it depends on a rather limited time span of between 30 to 90 minutes. Since, however, not the heat flow through the building element but the temperature of the side away from the fire is decisive for the accomplishment of a good heat insulation against the flow of heat the heat capacity of the building element plays an important role. It has been found that the temperature of the side away from the fire, in the event of fire, is correspondingly lower the thicker the sheets are. Especially it is noted that the side toward the fire should be thicker.

In the following fire-resistant glazing units according to the invention will now be described in greater detail.

As expected the security against fire spreading through the inventive fire resistant building unit is greatly improved. What is required of a fire resistant unit is described in German Industrial Standard 4102 (page 3, side 4, section 7), Edition 1970.

The best known fire resistant unit is of glass reinforced with wire or mirror reinforced with wire. It consists of a calcium sodium glass. For many structures the wire glass is not of an optical base.

A second useful group of fire resistant glazing units are sheets of glass ceramic of a lower thermal expansion value ($\alpha$). The product of the thermal expansion value $\alpha$ and the elasticity module E should be less than 1 [$kg \cdot cm^{-2} \cdot °C.^{-1}$]. Glass ceramics are glasses which have been transformed partially into a crystalline state by a particular heat treatment. Glass ceramics are available either transparent or non-transparent. Transparent and nontransparent glass ceramics with a product of $\alpha \cdot E$ less than 1 [$kg \cdot cm^{-2} \cdot °C.^{-1}$] are, for example, in the German Publication 1,596,858 and 1,596,863 described.

The glass ceramics are particularly well suited for building elements according to the invention since, in general, they first deform at temperatures over 800° to 900° C.

Another preferred group of heat resistant glazing units consist of glass sheets whose upper layer has been partially or completely hardened according to a special process. As hardening processes are thermal quenching, the chemical hardening through ion exchange as well as the hardening through upper surface crystallization. It is particularly advantageous if the glass sheet serving as the fireproof sheet has been made through partial hardening in its area of the frame under a particular compressive stress.

Special fire resistant sheets and processes for their manufacture are given in German Publication 2 313 442 and in German Publication 24 13 552 and 24 24 172.

According to the above, there are, for example, special glasses intended for fireproof sheets whose described product of thermal expansion ($\alpha$) and elasticity module (E) is between 1–5[$kg \cdot cm^{-2} \cdot °C.^{-1}$]. Preferably boron silicate and aluminum silicate glasses are used.

Since the inventive building elements show a high heat insulation the sheets toward the fire quickly rise to the temperature of the burning room. Sheets of glass begin to deform at about the softening point of the glass in about 15 to 20 minutes. It is therefore an advantage if the softening point of the fire resistant glass is as high as possible.

Particularly suitable are sheets of glass strengthened by upper surface crystallization. These sheets have the advantage that by means of the upper surface crystallization or by thermal quenching of the upper surface under pressure, the sheets during a fire and with the heating to the softening point form at their upper surface a growing crystalline layer through which this glass sheet remains intact even at the softening temperature of other glasses and at first begin to deform at generally higher temperatures such as 900° to 1000° C.

Because of the sound proofing needs it can be necessary that the glazing units have different thicknesses. A general improvement in the sound proofing can be achieved if instead of a single sheet one uses a sheet composite consisting of two sheets with a synthetic layer between. The building element according to the invention can also have an arrangement of a fire resistant glass sheet and a laminate glass wherein one of the two sheets of the laminated glass again can be a fire resistant sheet.

The success of the claimed fire safe building element depends on which function it is later able to fulfill. The building element is arranged whereby in the event of fire the building element hinders the passage of fire and smoke and the temperature of the side away from the fire should be as low as possible.

If a fire safe building element with glazing units is needed that only needs to possess a high heat insulation in one direction then at least must the sheet toward the fire be a fireproof glazing unit. The sheet away from the fire at which the temperature should be lowest, can consist of a hardened or an unhardened window glass (calcium, sodium glass with an $\alpha$ value (20°-300° C.) of approximately $90\times10^{-7}$[°C.$^{-1}$].

If fire is expected on both sides of the building element and the heat insulation must be workable in two directions then both sheets of a double glazing unit and preferably at least the outer sheets of a multi-glazing unit, must consist of fire resistant glazing units.

According to the invention the high heat reflective foil is arranged in rolls or in a folded condition between two sheets of the building element such that the visible area is not covered and the foil can, in the case of fire, however, be fully lowered and spread out between the sheets.

The arrangement of the foil between the sheets is done in such a manner that the foil, in the event of a fire, is installed so that it is automatically released (for example, by means of temperature or pressure devices between the sheets), and is completely spread out between the sheets.

This can be done so that one end of the heat reflective foil is fastened to the upper inner side of the frame between two sheets and the folded together or rolled up foil is held through intended means above the visible area of the unit, and that this means releases the foil during the first rise in heat in the event of fire so that the foil can be spread out by gravity between the sheets.

On the other hand, it is possible to fold the foil in the style of a harmonica and to weight them at their lower end by means of a rod intended for this purpose. A foil with this type of folding and whose lowered end is weighted can very quickly be spread between the sheets. The high heat reflective foil is preferably placed in a rolled up condition between the sheets. The fastening of the foil roll consists in this case of a mounting support for the roll and an automatic mechanism. The automatic mechanism is of any sort which is reponsive to a heat source. With the onset of a fire the automatic mechanism opens the mounting support and the heat reflective foil rolls out between the sheets.

The mounting support for the foil roll can be for example a light bendable wire, rope or chain on which the foil roll hangs or a thin bar or molding on which the roll is placed. The mounting support must be fastened at least on one side, preferably on the side toward the fire and over the automatic mechanism.

Automatic mechanisms which respond to the temperature can, for example, use low melting compounds (melting points between 50° and 200°), bimetals or receptacles with a low boiling fluid (boiling point between 50° and 200° C.). As low melting compounds one can use alloys (such as Wood's metal) waxes, or resins.

The heat reflective foils must be thin enough so that they can easily be rolled and unrolled. Preferably foils with a thickness of 30 plus to 10 microns are used. In order to improve the unrolling of the heat reflective material the foil can be rolled on a rod of a suitable material. If the foil material does not have suitable strength of its own to perform as expected when it is rolled down then the IR reflective substance can be used on suitable, temperature stable support material which can be wound up like a foil and unrolled in the case of a fire.

EXAMPLE 1

In FIG. 1 is shown a fire resistant building material of greater heat insulation with a visible area that is intended for an outside window double pane glazing unit. The visible area consists of two glass sheets $500\times500$ millimeters square sides and 7 millimeters thickness which are arranged in a distance of 20 millimeters from each other.

The outer sheet 3 consists of a fire resistant and visible material which does not break with the rapid heating in a fire. It is manufactured from a high boric acid containing glass of type D 50 which a thermal expansion value $\alpha$ (20°-300° C.) of $32.5\times10^{-7}$[°C.$^{-1}$] and an elasticity module E of $6.3\times10^{5}$ [kg/cm$^2$] and is made in the frame under high compressive stress. For the inner sheet 3' can a non-fire resistant glass sheet be used which can be an unhardened or hardened float glass or crystal mirror glass (Calcium, sodium glass with $\alpha$ of about $90\times10^{-7}$ [°C.$^{-1}$]). The upper distant spacer 6 between the sheets is a U-shape and is open below. On the underside of the upper distance spacer are fastened the two ends of 25 micron aluminum foil 7. Between the aluminum foil is found an iron rod 10 around which the foil is rolled such that it fits in the interspace of the U-shaped distant spacer. Below the above distant spacer is arranged a thin plate 11. This covering plate 11 lies on a small, $4\times4$ millimeters large scaling wax cubes 12, which are fastened tightly to the glass sheet. The aluminum foil roll lies on the covering plate.

The double glazing unit is framed in a three centimeter wide steel frame 8 with thickening slips 13 and heat insulation material 9.

In order to test the fire resistance and insulation properties the building element is built into the opening of a $1000\times1000\times1000$ millimeter size heating oven. In the first fire trial the element was so built in that the outside sheet 3 was towards the fire. At the onset of a fire beyond a structure the temperature rises to 660° C. in 10 minutes according to German Industrial Standard 4102, and then remains constant. All together the heating element should withstand the fire 30 minutes or longer. The heat insulation property of the building element should be so great that the temperature at the side of the inner sheet away from the fire at least in the middle remains under 140° C. For the fire trial the sheet 3 toward the fire was heated first. After a few (4 to 7)

minutes the sealing wax 12 melted and the plate 11 was bent from the weight of the iron rod 10 and the aluminum foil 7 rolled out between the sheets.

In the time until the aluminum rolled out between both sheets, the temperature of the side of the inner sheet 2 climbed to about 40° to 60° C. After the foil had fallen down, the temperature of the sheet 3' away from the fire for the next between 5 to 10 minutes remained constant and then in 10 to 15 minutes climbed to an end value of 85° to 130° C. The remaining time of the test until 90 minutes had elapsed the temperature remained constant. The highest temperature was observed in the upper half of the sheet while in the lower part of the sheet the temperature did not go past 100° C.

For the second fire trial the building element is so built in that now the inner sheet 3' is toward the fire. The temperature rise for a fire in the inner structure is again followed according to the standard temperature curve (German Industrial Standard 4102, Edition 1970, page 2, section 5.2.4). That is to say, that in the fire room it is to be expected that after thirty minutes a temperature of 821° C. is expected, after sixty minutes 925° C. and after ninety minutes 986° C. The building element should withstand the fire at least thirty minutes, if possible even for a duration of ninety minutes and thereby hinder a fire spreading from piece to piece. A heat insulation material in the building element is in this case neither necessary nor desirable. At this fire trial the inner sheet 3' directed towards the fire broke just after 2 to 5 minutes. The sealing wax 12 melted immediately after the sheet 3' is broken and the aluminum foil 7 rolled out. After 10 to 15 minutes the aluminum foil also melted since it was in direct contact with the hot air of the oven.

The fire resistant outer sheet 3 hindered the passage of the fire for at least 30 minutes. Since the aluminum distant spacer in this case melted the outer sheet must be separately fastened through the steel mounting support 13 and insulation material 9.

EXAMPLE 2

Figure 2:
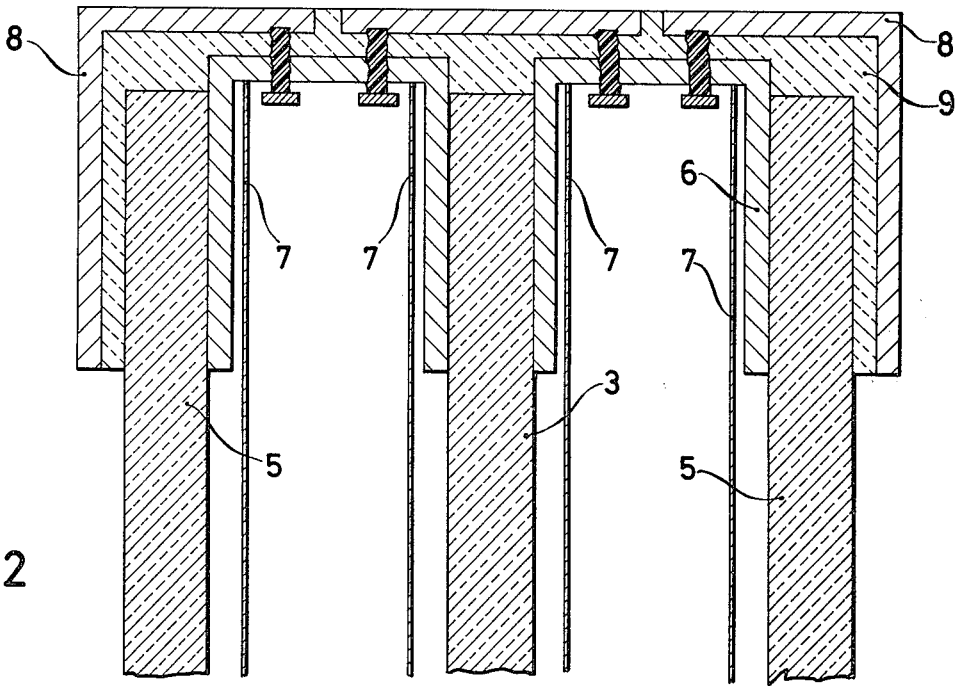
Figure 3:
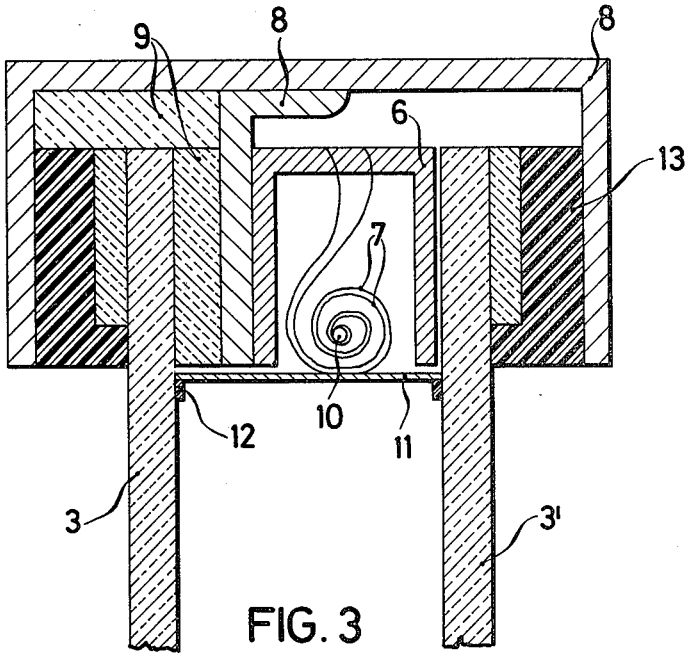
Figure 4:
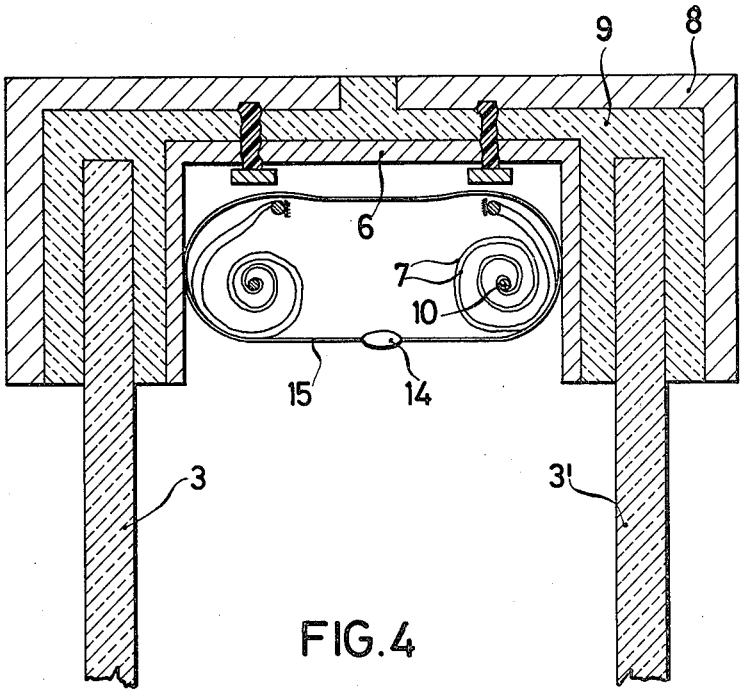

FIG. 2 shows a fire resistant building material with a higher heat insulation and with a visible area which is intended as a glazing unit in fire resistant partitions. The fire resistant transparent building element for fire resistant partitions is constructed similarly to the described building element in Example 1 which is intended for outside windows.

Both glass sheets of the building element are again in size 500×500 mm$^2$ wide and 5 mm thick. These sheets are prepared as was described in Example 4 and are of fire resistant glass sheets 3 which do not break with a rapid temperature rise which is the case in the event of fire. The distance between the sheets is 6 centimeters. The distant spacer 6 is made of steel. On the distance spacer above a thin (2–5 mm) heat insulation layer 9, both halves of the outer frame 8 are fastened. The outer frame 8 is interrupted by a 5 mm wide heat insulation layer. On the inner side of the upper distant spacer are the two ends of two aluminum foils 7 fastened such that a double foil is found as close as possible to each sheet. Between each of the double foils is laid a metal rod 10 and both foils are rolled up on it as is described in Example 1. The rolled together foils are fastened with a thin wire 15 to the upper distant spacers. The wire is interrupted through a trip mechanism 14 made of Wood's metal. As expected, the fire resistant partitions must according to German Industrial Standard 4102 withstand the fire for a length of 30 minutes and must not permit the side away from the fire to exceed 140° C. in the middle. With fire resistant partitions the heat insulation must be available in both directions.

For the fire trial according to German Industrial Standard 4102 (standard temperature curve) the temperature rises to about 628° C. in 30 minutes. In 4 to 6 minutes after the beginning of the trial the Wood's metal 14 melts and both aluminum foils 7 roll out between the sheets. Previous to the appearance of the foil rolls the temperature rises rapidly on the glass sheet diverting the fire. As soon as the strongly heat reflective foils are found between the sheets the temperature remains almost constant at the sheet away from the fire and from then climbs slowly for 12 to 15 minutes. After a fire length of 30 minutes the temperature of the sheet away from the fire was measured at between 65° and 125° C. which shows the highest temperature at the upper frame of the sheet and the lowest temperature on the bottom frame of the sheet.

What is claimed is:

1. Fire proof building element with a multi-sheet glazing unit of glass or glass ceramic characterized in that at least one of the glass sheets of the multi-sheet glazing unit is a fire resistant glass sheet consisting of a glass whose product of the thermal expansion unit $\alpha$ (20°–300° C.) and elasticity module E is between 1 and 5 (kg/cm$^2$·°C.), the distance between the sheets being between 2 mm and 150 mm, and characterized in that the building element contains one or more high heat reflective foils arranged between the sheets at a distance from the fire resistant glazing unit, the high heat reflective foil reflecting over 90% of the radiation, and also characterized in that the high heat reflective foil is put in a rolled up form or in a folded form between the two sheets of the building element such that the visible area is not covered and which can, in the event of a fire, be spread out completely between the glass sheets.

2. Fire proof building element according to claim 1 wherein the fire resistant glass sheets are designed to prevent passage of flame and smoke for 60 minutes, and wherein the building element including its mountings, fasteners and joints are resistant to the action of fire such that they remain workable as room closures and let neither flame nor smoke pass through during a 60 minute fire trial consistent with German Industrial Standard 4102.

3. Building element according to claim 1 characterized in that the fire resistant glazing unit consists of wire reinforced glass or wire-mirror glass (calcium-sodium glass).

4. Building element according to claim 2 characterized in that the fire resistant glazing unit consists of a glass ceramic wherein the product of the thermal expansion value, $\alpha$ (20°–300° C.) and elasticity module E, is smaller than 1 (kg/cm$^2$·°C.).

5. Building element according to claim 1 characterized in that the fire resistant glazing unit consists of glass sheets whose product of the thermal expansion unit $\alpha$ (20°–300° C.) and elasticity modulę E is between 1 and 5 (kg/cm$^2$·°C.) and which are put into the area of the frame by partial hardening under a compressive stress.

6. Building element according to claim 1 characterized in that the glass sheets consist of a glass whose softening point ($\eta = 10^{7.6}$ poise) is above 750° C.

7. Building element according to claim 1 characterized in that the glass sheets consist of a glass strengthened by upper surface crystallization.

8. Building element according to claim 1 characterized in that the glass sheets in the area of the frame of the sheet or on the total upper surface possess a crystalline upper surface layer with a lower thermal expansion value than the value of the base glass.

9. Building element according to claim 1 characterized in that, besides the fire resistant glass sheet, it has multi-glass sheets of one or more synthetic layers laminated together, which laminate is fire resistant.

10. Building element according to claim 1 characterized in that it is filled with a gas which has a thermal conductivity less than the thermal conductivity of air.

11. Building element according to claim 1 characterized in that the sheet away from the fire is thicker than the sheet toward the fire.

12. Building element according to claim 1 characterized in that this means for the automatic spreading of the foil is so arranged that it either responds to an increase in the environmental temperature or to an increase in the pressure between the sheets.

13. Building element according to claim 1 characterized in that the high heat reflective foils are fastened with their one end to an upper inner side of the frame between two sheets and that the foils rolled up or folded from bottom to top rest on a mounting support, which support has means which is activated through a completely automatic release mechanism in the case of a fire so that the foils are unrolled between the sheets by gravity.

14. Building element according to claim 13 characterized in that the foils are fastened at their other end on rods on which they are wound up.

15. Building element according to claim 14 characterized in that it contains two foils which are led around a common rod by joining together their other ends in a loop-type arrangement and the foils are rolled up on the rod.

16. Fire proof building element with a multi-sheet glazing unit of glass or glass ceramic characterized in that at least one of the glass sheets of the multi-sheet glazing unit is a fire resistant glass sheet and that the building element contains at least one high heat reflective layer or contains one or more high heat reflective foils arranged between the sheets at a distance from the fire resistant glazing unit, characterized in that the fire resistant glazing unit consists of glass sheets whose product of the thermal expansion unit $\alpha$ (20°–300° C.) and elasticity module E is between 1 and 5 (kg/cm$^2$·°C.) and which are put into the area of the frame by partial hardening under a compressive stress characterized in that the sheet away from the fire is thicker than the sheet toward the fire and the distance between the sheets is between 2 mm and 150 mm, also characterized in that the glass sheets consist of a glass that shows a strong curve at the upper surface crystallization, and characterized in that the glass sheets in the area of the frame of the sheet or on the total upper surface possess a crystalline upper surface with a lower thermal expansion value than the value of the base glass, the building element being filled with a gas which has a thermal conductivity less than the thermal conductivity of air, and also characterized in that the high heat reflective foils are made of aluminum or gold which reflect over 90% of the radiation, and also characterized in that the high heat reflective foil is put in a rolled up form or in a folded form between the two sheets of the building element such that the visible area is not covered and which can, in the event of a fire, be spread out completely between the sheets.

17. Building element according to claim 16 characterized in that it has a means through which the high heat reflective foils can be spread out in case of a fire completely automatically between the sheets.

18. Building element according to claim 17 characterized in that this means for the automatic spreading of the foil is so arranged that it either responds to an increase in the environmental temperature or to an increase in the pressure between the sheets.

19. Building element according to claim 16 characterized in that the high heat reflective foils are fastened with their one end to an upper inner side of the frame between two sheets and that the foils rolled up or folded from bottom to top rest on a mounting support, which support has means which is activated through a completely automatic release mechanism in the case of a fire so that the foils are unrolled between the sheets by gravity.

20. Building element according to claim 19 characterized in that the foils are fastened at their other end on rods on which they are wound up.

21. Building element according to claim 20 characterized in that it contains two foils which are led around a common rod by joining together their other ends in a loop-type arrangement and the foils are rolled up on the rod.

* * * * *

UNITED STATES PATENT AND TRADEMARK OFFICE

CERTIFICATE OF CORRECTION

PATENT NO. : 4,203,264

DATED : May 20, 1980

INVENTOR(S) : Werner Kiefer et al.

It is certified that error appears in the above—identified patent and that said Letters Patent is hereby corrected as shown below:

On the title page, Item [30] should read:

| | | |
|---|---|---|
| April 30, 1975 | Fed. Rep. of Germany | 2519176 |
| June 26, 1975 | Fed. Rep. of Germany | 2528440 |

Signed and Sealed this

*Eighteenth* Day of *November 1980*

[SEAL]

*Attest:*

SIDNEY A. DIAMOND

*Attesting Officer*

*Commissioner of Patents and Trademarks*